US012055292B2

(12) United States Patent
Noritake et al.

(10) Patent No.: US 12,055,292 B2
(45) Date of Patent: Aug. 6, 2024

(54) PREMIXING APPARATUS

(71) Applicant: RINNAI CORPORATION, Aichi (JP)

(72) Inventors: Katsuya Noritake, Aichi (JP); Takuya Miura, Aichi (JP)

(73) Assignee: RINNAI CORPORATION, Aichi (JP)

( * ) Notice: Subject to any disclaimer, the term of this patent is extended or adjusted under 35 U.S.C. 154(b) by 407 days.

(21) Appl. No.: 17/689,681

(22) Filed: Mar. 8, 2022

(65) Prior Publication Data

US 2022/0307691 A1 Sep. 29, 2022

(30) Foreign Application Priority Data

Mar. 26, 2021 (JP) ..... 2021-052665

(51) Int. Cl.

| | |
|---|---|
| ***F23N 1/02*** | (2006.01) |
| ***F23D 14/02*** | (2006.01) |
| ***F23L 5/02*** | (2006.01) |
| ***F24H 1/10*** | (2022.01) |

(52) U.S. Cl.

CPC ..... *F23N 1/025* (2013.01); *F23D 14/02* (2013.01); *F23L 5/02* (2013.01); *F23N 2231/10* (2020.01); *F23N 2235/16* (2020.01); *F23N 2235/24* (2020.01); *F24H 1/107* (2013.01)

(58) Field of Classification Search

CPC ..... F23N 1/025; F23D 14/02; F23L 5/02
USPC ..... 431/72
See application file for complete search history.

(56) References Cited

U.S. PATENT DOCUMENTS

| | | | | |
|---|---|---|---|---|
| 4,422,423 | A * | 12/1983 | Sugiyama | F02M 7/106 261/41.5 |
| 5,311,849 | A * | 5/1994 | Lambert | F02D 19/023 123/527 |
| 2010/0313843 | A1* | 12/2010 | Marushima | F01M 13/022 123/196 M |
| 2012/0046886 | A1* | 2/2012 | Bowling | G01F 1/34 29/888.011 |
| 2021/0041100 | A1 | 2/2021 | Noritake et al. | |

FOREIGN PATENT DOCUMENTS

| | | |
|---|---|---|
| JP | 2021-025722 A | 2/2021 |

* cited by examiner

*Primary Examiner* — Vivek K Shirsat
(74) *Attorney, Agent, or Firm* — Future IP LLC; Tomoko Nakajima

(57) ABSTRACT

A premixing apparatus for mixing air with a fuel gas to supply a burner with an air-fuel mixture via a fan includes: a zero governor and a motor-driven type of variable throttle valve, both being disposed in a gas supply passage; and an excess air ratio detecting device for detecting an excess air ratio of the air-fuel mixture, thereby regulating an opening degree of the variable throttle valve so that the excess air ratio of the air-fuel mixture becomes a predetermined value. An arrangement is made to prevent an ignition failure from occurring in an attempt to perform an ignition operation in a state in which, due to a trouble with the variable throttle valve of remaining opened or remaining closed, the excess air ratio of the air-fuel mixture becomes too small or too excessive. The variable throttle valve is provided with a sensing device.

4 Claims, 5 Drawing Sheets

PREMIXING APPARATUS

This application claims priority under 35 U.S.C. § 119 to Japanese Patent Application No. 2021-052665, filed Mar. 26, 2021, which is incorporated by reference.

TECHNICAL FIELD

The present invention relates to a premixing apparatus for mixing air with a fuel gas in order to supply a burner with an air-fuel mixture via a fan.

BACKGROUND ART

Conventionally, as this kind of premixing apparatus, there is known one in which a zero governor for controlling a secondary gas pressure to atmospheric pressure is interposed in a gas supply passage whose downstream end is connected to a gas suction part which is disposed in an air supply passage on an upstream side of the fan. The supply amount of a fuel gas varies with a differential pressure between the atmospheric pressure, which is the secondary gas pressure, and a negative pressure in the air supply passage. Since the negative pressure in the air supply passage varies with the rotational speed of the fan, the supply amount of the fuel gas varies with the rotational speed of the fan, i.e., varies in proportion to the supply amount of the air. Therefore, by controlling the rotational speed of the fan depending on the required combustion amount, the amount of the air-fuel mixture according to the required combustion amount is supplied to the burner and the excess air ratio (amount of primary air/amount of air in theoretical air-fuel ratio) becomes constant.

By the way, there are cases where the calorific value (Wobbe Index) of the fuel gas may fluctuate with the time of the day even if the same kind of gas is being used as the fuel gas. In the above-mentioned conventional example, even if the calorific value of the fuel gas may fluctuate, the ratio of the supply amount of air to the supply amount of the fuel gas remains constant. Therefore, accompanied by the fluctuation of the calorific value of the fuel gas, the excess air ratio of the air-fuel mixture may fluctuate, thereby resulting in poor combustion.

Under the circumstances, there is conventionally known in patent document 1 also a premixing apparatus which is provided with: a motor-driven type of variable throttle valve interposed in a portion, on a downstream side of a zero governor, of a gas supply passage; an excess air ratio detecting device for detecting the excess air ratio of the air-fuel mixture; and a control device. The control device is arranged to perform the control of an opening degree of the variable throttle valve such that the excess air ratio of the air-fuel mixture as detected by the excess air ratio detecting device becomes a predetermined value. According to this arrangement, even if the calorific value of the fuel gas may fluctuate, by the control of the variable throttle valve the excess air ratio of the air-fuel mixture can be maintained constant, thereby preventing the poor combustion from occurring.

However, according to the arrangement as described in the patent document 1, even if there should occur a trouble with the variable throttle valve, the abnormality with the variable throttle valve cannot be sensed until, after the ignition, the excess air ratio of the air-fuel mixture comes to be detectable by the excess air detection device. Therefore, there is a possibility that the ignition failure may occur as a result of performing ignition operation in a state in which, due to the trouble with the variable throttle valve of remaining opened or remaining closed, the excess air ratio of the air-fuel mixture becomes too small or too large.

PRIOR ART DOCUMENT

Patent Document

Patent Document 1: JP-A2021-25722

SUMMARY OF THE INVENTION

Problems that the Invention is to Solve

In view of the above points, this invention has a problem of providing a premixing apparatus which is arranged to be able to sense the trouble with the variable throttle valve before ignition, thereby increasing the safety.

Means of Solving the Problems

In order to solve the above problem, this invention is a premixing apparatus for mixing air with a fuel gas to supply a burner with an air-fuel mixture through a fan, including: a zero governor for regulating a secondary gas pressure to an atmospheric pressure, the zero governor being interposed in a gas supply passage whose downstream end is connected to a gas suction part disposed in an air supply passage on an upstream side of the fan; a motor-driven type of variable throttle valve interposed in a portion, on a downstream side of the zero governor, of the gas supply passage; an excess air ratio detecting device for detecting an excess air ratio of the air-fuel mixture; and a control device to perform control to adjust the opening degree of the air-fuel mixture so that the excess air ratio of the air-fuel mixture to be detected by the excess air ratio detecting device becomes a predetermined value. In the premixing apparatus the variable throttle valve is provided with a sensing device for sensing a movement of a valve body of the variable throttle valve, and the control device is constructed such that, at a time of ignition at the burner, a motor of the motor-driven type of variable throttle valve is rotated sequentially in one and an opposite of a valve-closing direction and a valve-opening direction and that, only when the movement of the valve body of the variable throttle valve by this rotation has been sensed by the sensing device, ignition control is performed.

According to this invention, even if the motor is rotated, in case the valve body does not move due to the variable throttle valve's trouble of remaining opened or remaining closed so that the sensing device fails to sense the movement of the valve body, the ignition control cannot be performed. Therefore, the ignition failure due to the variable throttle valve's trouble of remaining opened or remaining closed can be safely prevented in advance.

Further, in this invention, at the time of ignition at the burner, the motor of the variable throttle valve shall preferably be once rotated in the valve-closing direction and then rotated in the valve-opening direction such that the valve body of the variable throttle valve is moved to a predetermined ignition position. According to this operation, the waiting time from the starting of control for trouble sensing of the variable throttle valve to the ignition control can be shortened.

Still furthermore, in this invention, in case the valve body of the variable throttle valve has a needle part that is insertable into a valve hole formed in a valve seat of the variable throttle valve, preferably: the variable throttle valve has a diaphragm that lies opposite to the needle part, the diaphragm being positioned on a downstream side of the valve seat; the diaphragm is arranged to be deformed by a push of the valve body as a result of movement of the valve body of the variable throttle valve in the closing direction; and the sensing device is arranged to detect the displacement of the diaphragm. According to this arrangement, in case due to the trouble of the zero governor the secondary gas pressure becomes higher than the atmospheric pressure, irrespective of the movement of the valve body of the variable throttle valve, the diaphragm will be displaced by a push of the secondary pressure that is higher than the atmospheric pressure, and this displacement is sensed by the sensing device. Consequently, the trouble of the zero governor can also be sensed, to the benefit of higher safety.

MODES FOR CARRYING OUT THE INVENTION

Figure 1:
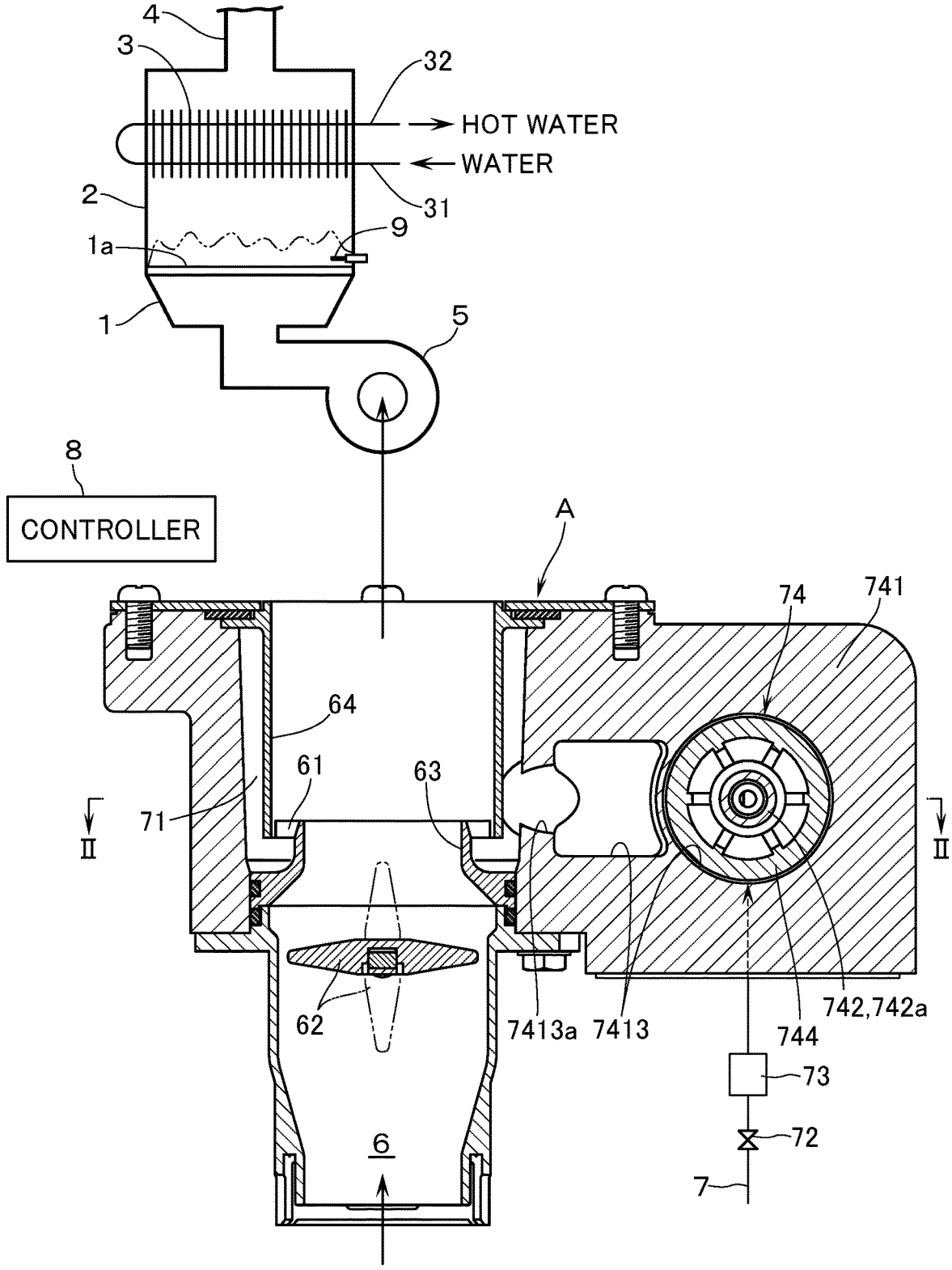
FIG. 1 is an explanation diagram showing the premixing apparatus according to an embodiment of this invention.

The combustion apparatus represented in FIG. 1 is a heat source apparatus comprising: a totally aerated combustion burner 1; a combustion box 2 enclosing a combustion space of an air-fuel mixture to be ejected from a combustion surface 1*a* of the burner 1; and a heat exchanger 3 disposed inside the combustion box 2. The heat exchanger 3 has connected thereto a water supply pipe 31 on an upstream side, and a hot water delivery pipe 32 on a downstream side. The combustion gas generated by the combustion of the air-fuel mixture is exhausted outside, after having heated the heat exchanger 3, through an exhaust tube 4 that is connected to an end part of the combustion box 2. By means of a premixing apparatus A according to an embodiment of this invention, air is mixed with a fuel gas, and the resultant air-fuel mixture is supplied to the burner 1 through a fan 5.

The premixing apparatus A is provided with: an air supply passage 6 on the upstream side of the fan 5; a gas supply passage 7 for supplying the fuel gas; and a controller 8 which is a control device. The downstream end of the gas supply passage 7 is connected to a gas suction part 61 which is disposed in the air supply passage 6. In a portion, adjacent to the upstream side of the gas suction part 61, of the air supply passage 6, there is disposed a venturi part 63 of a smaller diameter than the portion in which a butterfly valve 62 is disposed. The butterfly valve 62 will be described in detail hereinafter. The portion, adjacent to the downstream side of the venturi part 63, of the air supply passage 6 is enclosed by a tubular part 64 which is larger in diameter than the venturi part 63. The downstream end of the venturi part 63 is then inserted, while leaving an annular clearance, into the upstream end of the tubular part 64. This clearance constitutes a gas suction part 61. The downstream end of the gas supply passage 7 is provided with a gas chamber 71 which is in communication with the gas suction part 61 in a manner to enclose the tubular part 64. In addition, the gas supply passage 7 has interposed therein, from the upstream side downward in sequence, a main valve 72, a zero governor 73 which adjusts the secondary gas pressure to atmospheric pressure, and a variable throttle valve 74.

The amount of the fuel gas to be supplied through the gas suction part 61 varies with a differential pressure between the atmospheric pressure that is the secondary gas pressure and the negative pressure in the air supply passage 6. It is to be noted here that the negative pressure in the air supply passage 6 varies with the rotational speed of the fan 5. Therefore, the supply amount of the fuel gas varies in proportion to the rotational speed of the fan 5, i.e., in proportion to the supply amount of air. Further, the ratio of the supply amount of the fuel gas to the supply amount of air varies with the opening degree of the variable throttle valve 74. By making the opening degree of the variable throttle valve 74 to a predetermined reference opening degree according to the kind of gas to be used, the excess air ratio of the air-fuel mixture will become an appropriate value (e.g., 1.3). Then, by controlling the rotational speed of the fan 5 according to the required combustion amount (the amount of combustion required to supply hot water at a set hot water temperature), the air-fuel mixture can be supplied to the burner 1 in an amount according to the required combustion amount at the appropriate value of excess air ratio.

By the way, in order to prevent poor exhausting due to entry of the wind into the exhaust tube 4, i.e., in order to secure the wind resistance performance, the lower-limit rotational speed of the fan 5 cannot be set to a considerably lower value. In addition, in case the required combustion amount has fallen below the predetermined value corresponding to the lower-limit rotational speed of the fan 5, the air corresponding to the required combustion amount can no longer be supplied.

As a solution, in a portion, on an upstream side of the gas suction part 61, of the air supply passage 6, there is disposed a butterfly valve 62 that can be switched by a motor 621 (see FIG. 2) between a closed posture as illustrated in solid lines in FIG. 1 and an open posture as illustrated in imaginary lines in order to switch the flow resistance at the portion in question between two stages of large one and small one. In this arrangement, in case the required combustion amount has fallen below the above-mentioned predetermined value, the butterfly valve 62 is switched to the closed posture to thereby increase the flow resistance in the air supply passage 6. According to this operation, it is possible to supply air in an amount corresponding to the predetermined required combustion amount below the required amount without making the rotational speed of the fan 5 below the lower-limit rotational speed.

It is to be noted that, by simply making the butterfly valve 62 to the closed posture to thereby increase the flow resistance in the air supply passage 6, the negative pressure inside the air supply passage 6 will increase and the supply amount of the fuel gas will become excessive. Therefore, the excess air ratio of the air-fuel mixture to be supplied to the burner 1 will fall below the appropriate value. As a solution, in case the required combustion amount is relatively small, the butterfly valve 62 is switched to the closed posture and, at the same time, the opening degree of the variable throttle valve 74 is changed to a predetermined small-capacity opening degree that is smaller than the predetermined reference opening degree. According to these operations, the combustion capacity is changed to the small capacity so that the air-fuel mixture can thus be supplied to the burner 1 in an amount corresponding to a relatively small required combustion amount having the appropriate value in the excess air ratio. In case the required combustion amount is relatively large, the butterfly valve 62 is switched to the open posture and, at the same time, the opening degree of the variable throttle valve 74 is changed to a large-capacity opening degree that is the reference opening degree. According to the above operations, the combustion capacity is switched to the large capacity, and the air-fuel mixture whose excess air ratio is the appropriate value and that corresponds to a relatively large required combustion amount can be supplied to the burner 1.

By the way, even if the same kind of gas is being used as the fuel gas, there are cases where the calorific values (Wobbe Index) may fluctuate with the time of the day. In this case, when the ratio of the supply amount of the fuel gas to the supply amount of air is constant, the excess air ratio of the air-fuel mixture will fluctuate due to the fluctuation in the calorific value of the fuel gas, thereby resulting in poor combustion.

As a solution, there is provided an excess air ratio detecting device (or detecting means) 9 for detecting the excess air ratio of the air-fuel mixture. In this embodiment, a flame rod provided in a manner to face the combustion surface 1*a* of the burner 1 constitutes the excess air ratio detecting device 9. In other words, the excess air ratio of the air-fuel mixture is detected by the flame current that flows through the flame rod. By the way, since the flame moves toward or away from the combustion surface 1*a* depending on the excess air ratio of the air-fuel mixture, the rear-surface temperature of the combustion surface 1*a* varies with the excess air ratio of the air-fuel mixture. Therefore, it is also possible to constitute the excess air ratio detecting device 9 by a temperature sensor for detecting the rear-surface temperature of the combustion surface 1*a*.

The controller 8 performs a feed-back control in which the opening degree of the variable throttle valve 74 is regulated so that the excess air ratio of the air-fuel mixture as detected by the excess air ratio detecting device 9 becomes constant, i.e., so that the excess air ratio can be maintained at a predetermined appropriate value. In concrete, when the excess air ratio of the air-fuel mixture is reduced by an increase in the calorific value of the fuel gas, the opening degree of the variable throttle valve 74 is reduced so that the ratio of supply amount of the fuel gas to the supply amount of the air is reduced to attain the appropriate value. On the other hand, when the excess air ratio of the air-fuel mixture is increased by a decrease in the calorific value of the fuel gas, the opening degree of the variable throttle valve 74 is increased so that the ratio of supply amount of the fuel gas to the supply amount of the air is increased to attain the appropriate value. According to these operations, even if the calorific value of the fuel gas fluctuates, the excess air ratio of the air-fuel mixture can be maintained at the appropriate value, thereby preventing the poor combustion from occurring.

Figure 2:
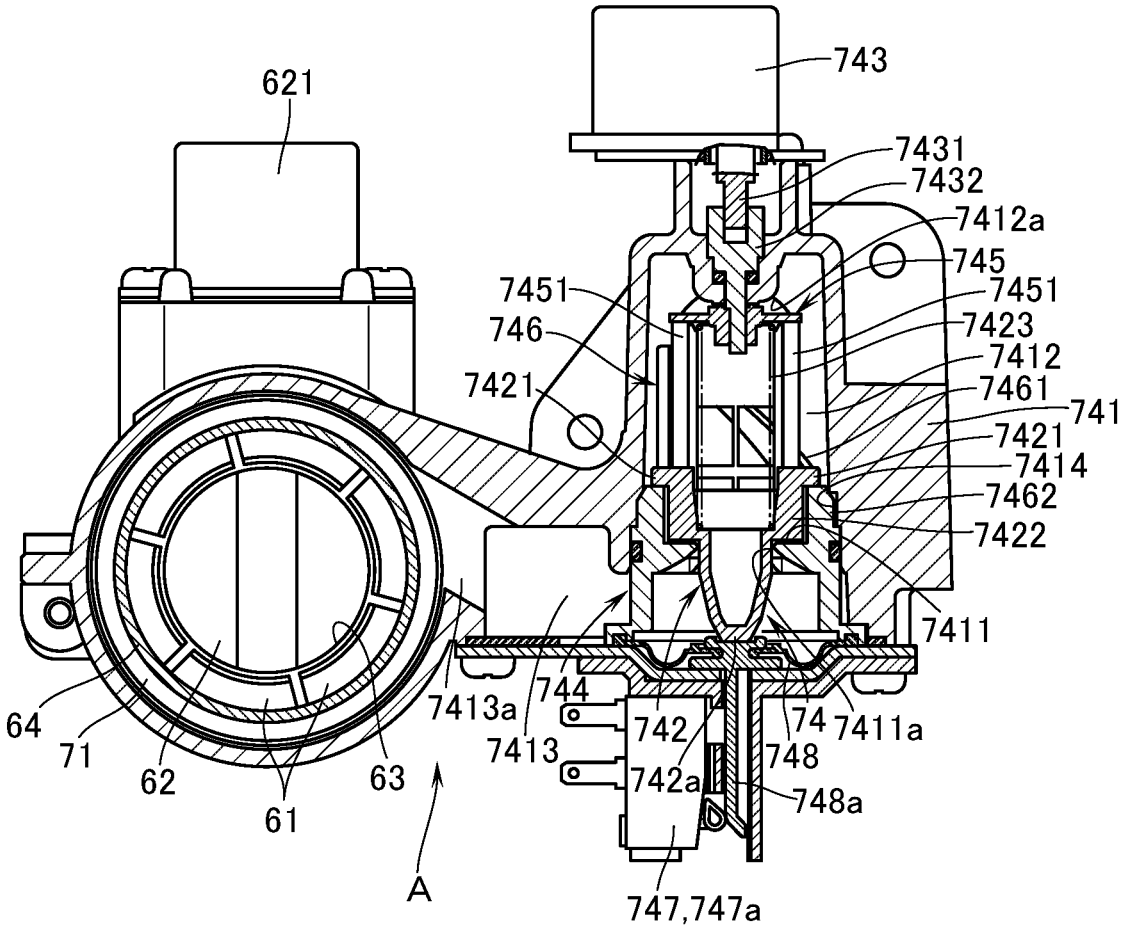
FIG. 2 is a sectional view taken along the line II-II in FIG. 1.
Figure 3:
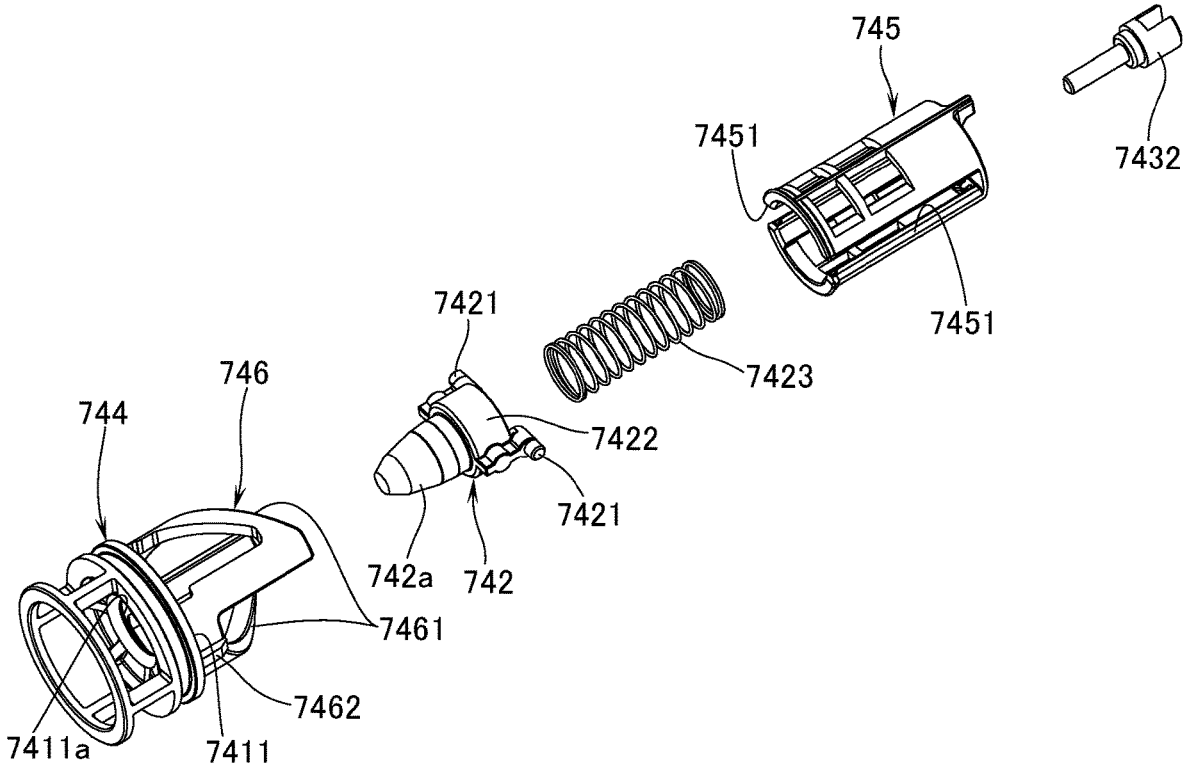
FIG. 3 is an exploded perspective view of an essential part of a variable throttle valve to be disposed in the premixing apparatus of the embodiment.
Figure 4:
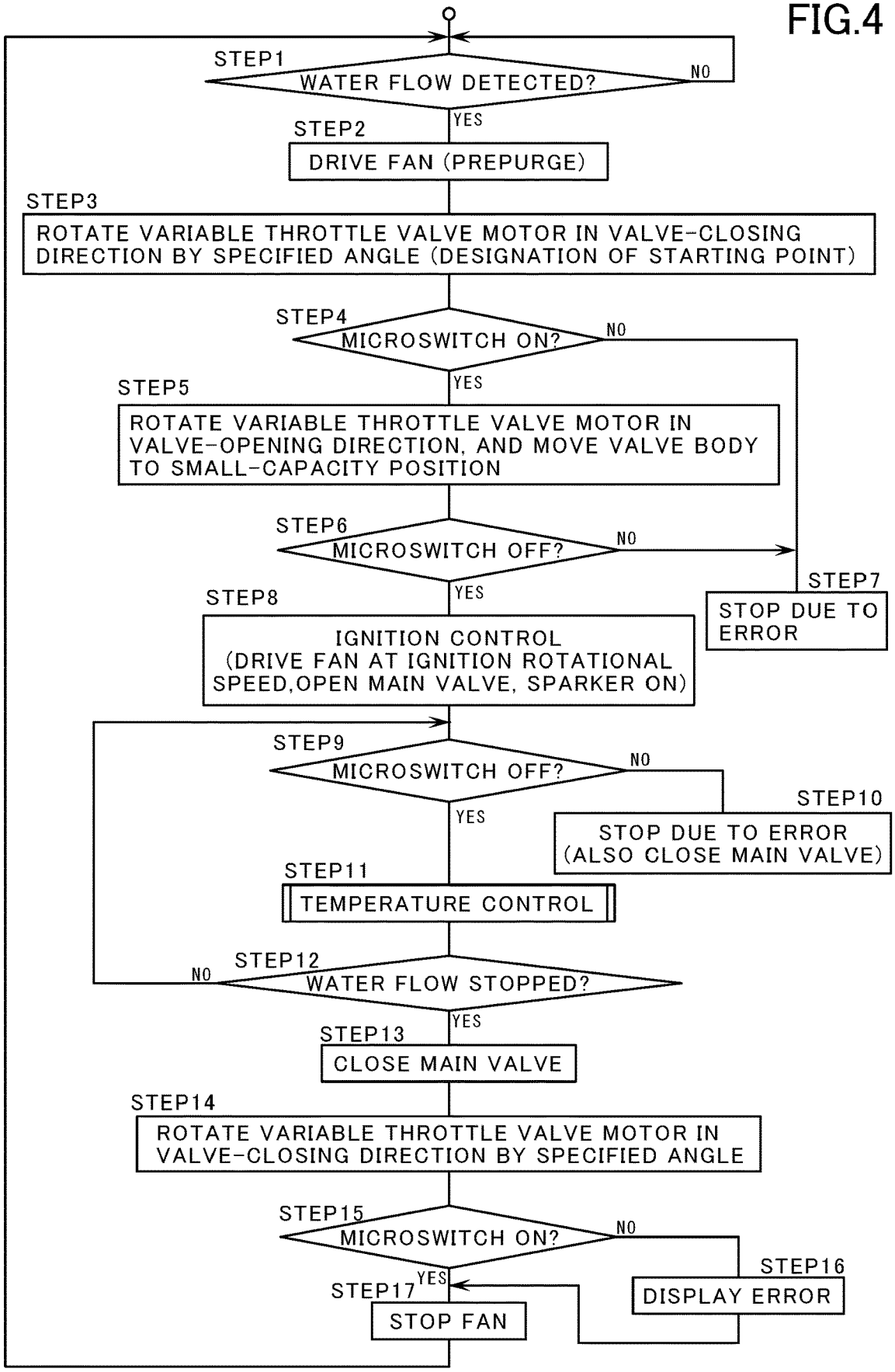
FIG. 4 is a flow diagram showing the contents of the control by a control device in the premixing apparatus of the embodiment.

Next, a description will be made of the construction of the variable throttle valve 74. With reference to FIGS. 2 and 4, the variable throttle valve 74 is of a motor-driven type and is made up of; a valve body 742 which is axially moveable toward or away from a valve seat 7411 in a valve box 741; a motor 743 constituted by a stepping motor; and a motion converting mechanism which moves the valve body 742 axially by the rotation of the motor 743. Inside the valve box 741 there are provided a primary gas chamber 7412 having a gas inlet 7412*a*; and a secondary gas chamber 7413 having a gas outlet 7413*a* which is in communication with the above-mentioned gas chamber 71. The secondary gas chamber 7413 has mounted therein a member 744 in which is formed a valve seat 7411 for partitioning the primary gas chamber 7412 and the secondary gas chamber 7413.

The motion converting mechanism is made up of: cam pins 7421 which are fixed to the valve body 742; a guide tube 745 having formed therein axially elongated grooves 7451 with which the cam pins 7421 are brought into slidable engagement; and a cylindrical cam body 746 having a spiral cam part 7461 with which the cam pins 7421 get engaged through the elongated grooves 7451. And a non-circular cross-sectional shaft part of a coupling element 7432 to be connected to an output shaft 7431 of the motor 743 is fitted to an end part of the guide tube 745 so that the guide tube 745 can be rotated by the rotation of the motor 743.

In addition, the valve body 742 has: a needle part 742*a* insertable into a valve hole 7411*a* formed in the valve seat 7411; and a cylindrical part 7422 inserted into the guide tube 745. At an end part of this tube part 7422, the cam pins 7421 are disposed in a manner to protrude radially outward. Further, a base part of the cam pins 7421 are slidably engaged with the elongated grooves 7451 formed in the guide tube 745. Therefore, the valve body 742 is coupled to the guide tube 745 in a manner to be axially movable relative to the guide tube 745 and is also rotatable together.

The cam body 746 is prevented from rotating relative to the valve box 741. In concrete, by engaging ribs 7462, disposed in a projecting manner on the peripheral surface of the cam body 746, with grooves 7414 formed on the inner periphery of the valve box 741, the cam body 746 is prevented from rotating relative to the valve box 741. Further, in order to reduce the number of parts, the cam body 746 is formed integrally with the member 744 having formed the valve seat 7411. The cam part 7461 disposed in the cam body 746 are constituted by spiral inclined sides that can be brought into contact with the cam pins 7421. There is also disposed a spring member 7423 which urges the cam pins 7421 toward the cam part 7461. Then, by the rotation of the motor 743 in the forward or reverse direction of rotation, the cam pins 7421 will be moved in axially one direction or in the opposite direction while it is rotated and guided by the cam part 7461. According to the above-mentioned arrangements, the valve body 742 will be moved in the closing direction in which the valve body 742 approaches the valve seat 7411 or in the open direction in which the valve body 742 goes away from the valve seat 7411.

The ignition at the burner 1 is performed by changing the combustion capacity to the small capacity (the butterfly valve 62 is in the closed posture; the opening degree of the variable throttle valve 74 is in the small-capacity opening degree), and the rotational speed of the fan 5 is made to be a predetermined speed. It is to be noted here that, even if a trouble happens to the variable throttle valve 74, the abnormality of the variable throttle valve 74 cannot be sensed until the excess air ratio of the air-fuel mixture comes to be detectable by the excess air ratio detecting device 9 after the ignition. Therefore, the ignition operation will be performed in a state in which, due to the variable throttle valve's trouble of remaining opened or remaining closed, the excess air ratio of the air-fuel mixture has become too small or too large, thereby leading to the possibility of giving rise to the poor ignition.

As a solution, in this embodiment, the variable throttle valve 74 is provided with a sensing device 747 for detecting the movement of the valve body 742 of the variable throttle valve 74. If explained in concrete, the variable throttle valve 74 is provided, in a position on the downstream side of the valve seat 7411, with a diaphragm 748 which lies opposite to the needle part 742*a* of the valve body 742. It is thus so arranged that the diaphragm 748 is displaced in the closing direction by a push from the valve body 742 (needle part 742*a*) as a result of the movement of the valve body 742 in the closing direction. In order to be able to detect the displacement of the diaphragm 748, the sensing device 747 is constituted by a micro switch 747*a* which cooperates with a dog 748*a* coupled to the diaphragm 748. The micro switch is set to be switched on when the valve body 742 is moved more toward the closing direction than the small-capacity position (the valve body 742 position in which the opening degree of the variable throttle valve 74 becomes the small-capacity opening degree) so as to reach the neighborhood of the stroke end position (position as shown in FIG. 2) in the closing direction.

With reference to FIG. 4, a detailed description will be made of the control that is performed by the controller 8. When a hot water faucet (not illustrated) on a downstream end of the hot water supply pipe 32 is opened and the water flow to the heat exchanger 3 is detected (sensed) by a water sensor (not illustrated) (STEP 1), the fan 5 is driven for pre-purging (STEP 2), and the motor 743 of the variable throttle valve 74 is rotated by a specified angle in a valve-closing direction (the direction of rotation in which the valve body 742 is moved in the closing direction) (STEP 3). This specified angle is set to an angle slightly larger than the angle that is required to move the valve body 742 from the large-capacity position (position of the valve-body 742 in which the opening degree of the variable throttle valve 74 becomes the large-capacity opening degree) to the stroke end position in the valve-closing direction. Then, after the valve body 742 has reached the stroke end position in the closing direction, the motor 743 is rotated out of phase so as to find out the starting point. Then, distinction is made as to whether the micro switch 747*a* has been switched on (STEP 4). If the variable throttle valve 74 is normal, the micro switch 747*a* will be switched on, but should the variable throttle valve 74 give rise to a trouble of being left open, the micro switch 747*a* will not be switched on. In this case, the system will be stopped due to error (STEP 7).

When the micro switch 747*a* has been switched on, the motor 743 of the variable throttle valve 74 is rotated in a valve-opening direction (the direction of rotation in which the valve body 742 is moved in the opening direction) so as to move the valve body 742 to the small-capacity position which is the ignition position (STEP 5). In this state distinction is made as to whether the micro switch 747*a* has been switched off (STEP 6). If the variable throttle valve 74 is normal, the micro switch 747*a* will be switched off but, if the variable throttle valve 74 has given rise to a trouble of being left closed, the micro switch 747*a* will not be switched off. In this case, the system will be stopped due to error (STEP 7).

When the micro switch 747*a* has been switched off, the fan 5 is driven at the rotational speed at the time of ignition. Further, the ignition control is performed in which the main valve 72 is opened and also the sparker (not illustrated) is switched on (STEP 8). According to this embodiment, in case the valve body 742 does not move even if the motor 743 is rotated, the failure to move being due to the troubles of the variable throttle valve 74 being left open or being left closed. The ignition control will thus be not performed. Therefore, the poor ignition due to the troubles of the variable throttle valve 74 being left open, or being left closed can be prevented in advance, thereby securing safety.

By the way, the following procedures are also possible. Namely, the motor 743 of the variable throttle valve 74 is first rotated in the valve-opening direction, and distinction is made as to whether the micro switch 747*a* has been switched off. Then, the motor 743 is rotated in the valve-closing direction, and distinction is made as to whether the micro switch 747*a* has been switched on. Thereafter, the motor 743 is again rotated in the valve-opening direction to thereby move the valve body 742 to the small-capacity position. However, according to the above procedures, the waiting time from the starting of control for trouble sensing of the variable throttle valve 74 to the ignition control will become long. On the other hand, according to this embodiment, as the control for trouble sensing of the flow regulation valve 74, the initial rotation of the motor 743 in the valve-opening direction becomes unnecessary. As a result, the waiting time from the start of control of trouble sensing for the variable throttle valve 74 to the ignition control can be shortened.

By performing the ignition control as described above, distinction is subsequently made as to whether the micro switch 747*a* has been switched off (STEP 9). Here, due to the trouble of the zero governor 73, if the secondary gas pressure has become higher than the atmospheric pressure, the diaphragm 748 will be pushed by the secondary gas pressure that is higher than the atmospheric pressure, whereby the diaphragm will be displaced in the closing direction by a push by the secondary gas pressure that is higher than the atmospheric pressure, whereby the micro switch 747*a* will be switched on. Therefore, when the micro switch 747*a* has been switched on, a stop due to error inclusive of closing of the main valve 72 is performed (STEP 10). In this manner, according to this embodiment, the trouble of the zero governor 73 can also be sensed, whereby safety is still more improved.

If the micro switch 747*a* remains switched off, then, a temperature control is performed including switching of the combustion capacity for feeding hot water at a set temperature (STEP 11). Thereafter, when the water flow is stopped (STEP 12), the main valve 72 is closed (STEP 13) and, at the same time, the motor 743 of the variable throttle valve 74 is rotated in the valve-closing direction by the above-mentioned specified angle (STEP 14). Thereafter, a distinction is made as to whether the micro switch 747*a* has been switched on (STEP 15). Then, in case the micro switch 747*a* has been switched on, the fan 5 is stopped (STEP 17). On the other hand, in case the micro switch 74*a* is not switched on, based on a judgment that the variable throttle valve 74 has given rise to a trouble of being left open, an error display is made (STEP 16), and then the fan 5 is stopped (STEP 17).

Figure 5:
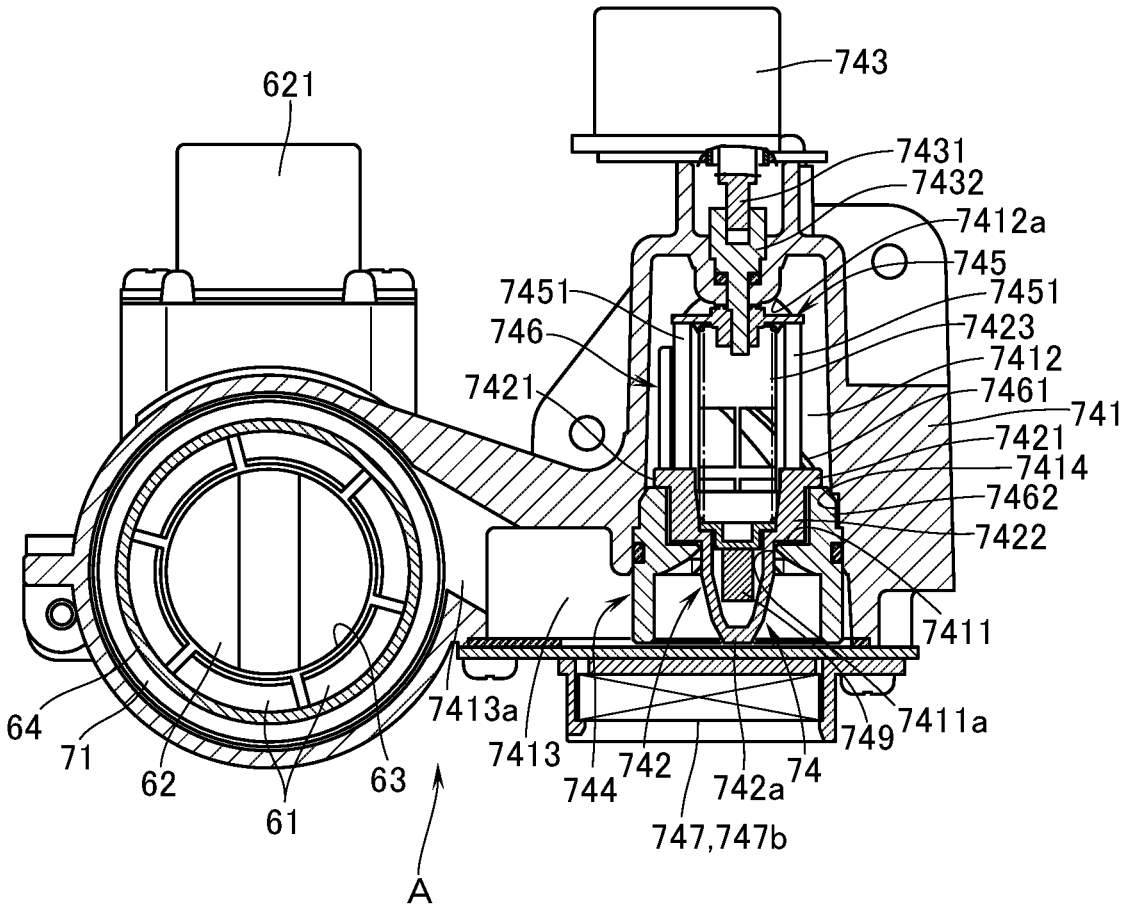
FIG. 5 is a sectional view corresponding to FIG. 2 of the premixing apparatus according to another embodiment.

Next, with reference to FIG. 5, a description will be made of another embodiment in which the arrangement of the sensing device 747 for sensing the movement of the valve body 742 of the variable throttle valve 74 has been modified. In this embodiment, a permanent magnet 749 is embedded inside the needle part 742*a* of the valve body 742. The sensing device 747 is constituted by a lead switch 747*b* which is disposed in a position lying opposite to the needle part 742*a* on an outside surface of the secondary gas chamber 7413. Then, when the valve body 742 has been moved more in the valve-closing direction than the small-capacity position, at the time when the valve body 742 has reached the neighborhood of the stroke end position (the position as shown in FIG. 5) of the valve-closing direction, the lead switch 747*b* is arranged to be switched on by receiving the magnetic force of the permanent magnet 749.

In this arrangement, too, at the time of ignition at the burner 1, the motor 743 of the variable throttle valve 74 is sequentially rotated in one and the opposite of the valve-closing direction and the valve-opening direction. Only when the movement of the valve body 742 of the variable throttle valve 74 due to this rotation has been sensed by the ON or OFF of the lead switch 747*b*, ignition control is performed. According to this arrangement, the ignition failure due to the trouble in the variable throttle valve 74 of remaining opened or remaining closed can be prevented in advance.

Descriptions have so far been made of the embodiments of this invention with reference to the drawings, but this invention shall not be limited to the above. Within a scope not exceeding the essence of this invention, various modifications are available.

EXPLANATION OF REFERENCE CHARACTERS

A premixing apparatus
1 burner
5 fan
6 air supply passage
61 gas suction part
7 gas supply passage
73 zero governor
74 variable throttle valve
7411 valve seat
7411*a* valve hole
742 valve body
742*a* needle part
743 motor
747 sensing device
748 diaphragm
8 controller (control device)
9 excess air ratio detecting device (detecting means)

The invention claimed is:

1. A premixing apparatus for mixing air with a fuel gas to supply a burner with an air-fuel mixture through a fan, including:

a zero governor for regulating a secondary gas pressure to an atmospheric pressure, the zero governor being interposed in a gas supply passage whose downstream end is connected to a gas suction part disposed in an air supply passage on an upstream side of the fan; a motor-driven type of variable throttle valve interposed in a portion, on a downstream side of the zero governor, of the gas supply passage; an excess air ratio detecting device for detecting an excess air ratio of the air-fuel mixture; and a control device to perform control to adjust the opening degree of the air-fuel mixture so that the excess air ratio of the air-fuel mixture to be detected by the excess air ratio detecting device becomes a predetermined value;

wherein the variable throttle valve is provided with a sensing device for sensing a movement of a valve body of the variable throttle valve, and wherein the control device is constructed such that, at a time of ignition at the burner, a motor of the variable throttle valve is rotated sequentially in one and an opposite of a valve-closing direction and a valve-opening direction and that, only when the movement of the valve body of the variable throttle valve by this rotation has been sensed by the sensing device, ignition control is performed.

2. The premixing apparatus according to claim 1, wherein, at the time of ignition at the burner, the motor of the variable throttle valve is once rotated in the valve-closing direction and then rotated in the valve-opening direction such that the valve body of the variable throttle valve is moved to a predetermined ignition position.

3. The premixing apparatus according to claim 1, wherein the valve body of the variable throttle valve has a needle part that is insertable into a valve hole formed in a valve seat of the variable throttle valve, wherein: the variable throttle valve has a diaphragm that lies opposite to the needle part, the diaphragm being positioned on a downstream side of the valve seat; the diaphragm is arranged to be displaced by a push of the valve body as a result of movement of the valve body of the variable throttle valve in the closing direction; and the sensing device is arranged to detect the displacement of the diaphragm.

4. The premixing apparatus according to claim 2, wherein the valve body of the variable throttle valve has a needle part that is insertable into a valve hole formed in a valve seat of the variable throttle valve, wherein: the variable throttle valve has a diaphragm that lies opposite to the needle part, the diaphragm being positioned on a downstream side of the valve seat; the diaphragm is arranged to be displaced by a push of the valve body as a result of movement of the valve body of the variable throttle valve in the closing direction; and the sensing device is arranged to detect the displacement of the diaphragm.

* * * * *